US007237477B1

(12) United States Patent
Fox

(10) Patent No.: US 7,237,477 B1
(45) Date of Patent: Jul. 3, 2007

(54) COMPACTOR/BALER WITH BUILT-IN SUPPLY STORAGE

(76) Inventor: Anthony Fox, 8306 Queen Ave. South, Minneapolis, MN (US) 55431

( * ) Notice: Subject to any disclaimer, the term of this patent is extended or adjusted under 35 U.S.C. 154(b) by 0 days.

(21) Appl. No.: 11/460,331

(22) Filed: Jul. 27, 2006

(51) Int. Cl.
*B65B 13/04* (2006.01)
*B30B 9/30* (2006.01)

(52) U.S. Cl. ..... 100/3; 100/24; 100/25; 100/34

(58) Field of Classification Search ..... 100/1, 100/2, 3, 8, 24, 25, 26, 34, 19 R
See application file for complete search history.

(56) References Cited

U.S. PATENT DOCUMENTS 228,515 A * 6/1880 Cook ..... 100/8
5,062,358 A * 11/1991 Fox ..... 100/218
5,575,199 A * 11/1996 Yamamoto ..... 100/34
5,699,727 A * 12/1997 Schwelling ..... 100/3
6,474,226 B1 * 11/2002 Sutton et al. ..... 100/3

* cited by examiner

*Primary Examiner*—Jimmy Nguyen
(74) *Attorney, Agent, or Firm*—Steven E. Kahm; Nikolai & Mersereau, P.A.

(57) ABSTRACT

A trash compactor is provided with a channel in the cavity of the trash compactor for allowing string to pass behind and below the compacted trash in the cavity of the trash compactor making it easy to secure the compacted trash in bales before removing the bale from the cavity of the trash compactor. The channels are inside of the bottom and back walls of the cavity and allow a strap therein to draw a string from the top back wall of the cavity to the front of the bottom wall of the cavity. The string can then be extended to circumnavigate the bale and be tied off before removing the bale from the cavity. The straps can be reinserted in the channels ready to pull string around the back and underneath the next bale.

4 Claims, 2 Drawing Sheets

COMPACTOR/BALER WITH BUILT-IN SUPPLY STORAGE

BACKGROUND OF THE INVENTION

1. Field of the Invention

This invention relates to trash compactors and more specifically to baling trash in the trash compactor.

2. Description of the Related Art

Most trash compactors compress trash in the compactor into a cube shape but when the trash is removed the trash tends to expand and unless contained in a bag or box the cube of compacted trash tends to expand and fall apart making the compacted trash hard to handle and move from the trash compactor to a waste container such as a dumpster or for shipping to a land fill.

It would be an advantage to be able to bale the compacted trash in the trash compactor before removing the compacted trash and transporting it to waste storage and thereafter to a landfill or other waste disposal facility.

SUMMARY OF THE INVENTION

A trash compactor is shown having a cavity for compacting trash into a cube by a platen pressing downward. The trash compactor is equipped with recesses in a wall and the floor of the trash compactor cavity such that a metal band can slide inside of the recess. The metal band can have a string, rope, twine, webbing, wire, tape or other material attached at one end and drawn along with the metal band such that as the band is withdrawn from the cavity the string is pulled behind and under the cubic bale of trash. The string once presented under the front of the cubic bale can be pulled to extend more string such that a sufficient length is available to tie around the cubic bale to keep it from expanding after removal from the trash compactor cavity.

The metal bands can then be reinserted in the cavity to their original positions such that the cavity is ready to receive and compact another bale of trash.

OBJECTS OF THE INVENTION

It is an object of the invention to provide an easy way to wrap string around a bale of compacted trash in the cavity of a trash compactor without removing the bale from the trash compactor cavity before it is baled.

It is an object of the invention to quickly and easily bale trash in a trash compactor.

It is an object of the invention to provide a way to pull baling string around the back and under a bale of compacted trash without undue resistance of the string between the compacted trash and the cavity walls or base.

It is an object of the invention to provide a storage area for the baling string and an easy way to use the string stored in the storage area.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
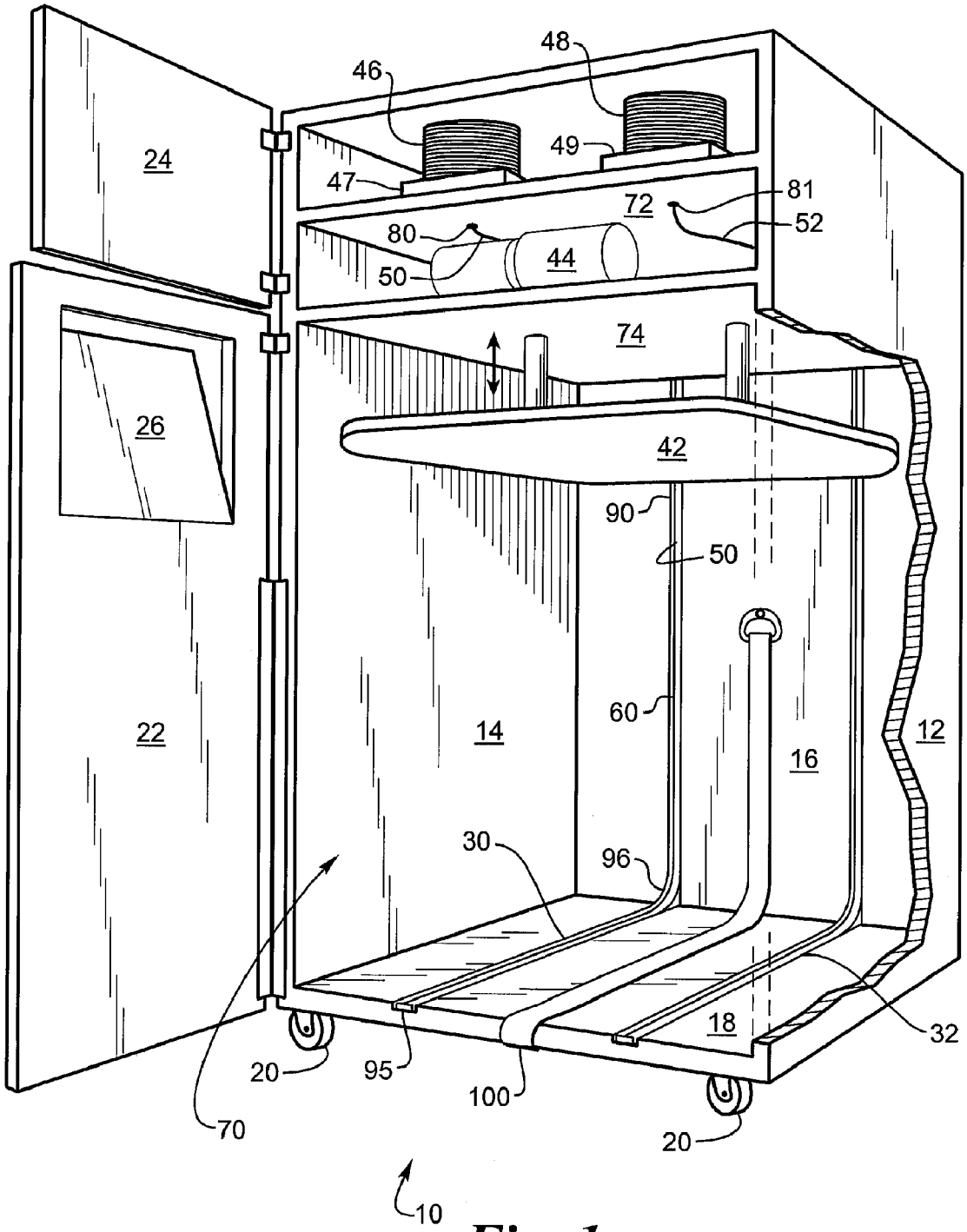
FIG. 1 is a perspective view of the trash compactor showing the bailing feature.

As shown generally in FIG. 1 a trash compactor 10 has a cavity 70 for compacting trash comprising a right wall 12, a left wall 14, a back wall 16, a bottom wall 18, a front wall provided by door 22, and a movable top wall provided by platen 42 which moves up and down in the cavity to compact trash. A flap type door 26 allows the insertion of trash into the trash compactor 10 through the top portion of door 22.

In the embodiment shown the platen 42 is hydraulically driven by hydraulics 44 above the cavity 70. In other embodiments the platen 42 need not be at the top and other means for driving the platen 42 may be used.

After the trash compactor 10 compresses the trash in cavity 70 the cube of trash in the cavity 70 should be baled so that it remains in a cube and is easier to handle for transporting, storing and disposal. In order to bale the cube of compacted trash it is necessary to surround the bale with a baling material such as twine, rope, string, a webbing material, tape or wire. As shown FIG. 1 a string 50 on a spool of string 46 is placed in a container 47 to provide string 50 to bale the left side of the compacted trash in cavity 70 and a string 52 on a spool 48 in container 49 provides string for the right side of the compacted trash in cavity 70. String 50 from spool 46 runs through aperture 80 in spool shelf 72 and then travels in channel 30 behind hydraulics shelf 74 and stays in channel 30 behind platen 42 to enter cavity 70. Similarly string 52 from spool 48 runs through aperture 81 in spool shelf 72 and then travels in channel 32 behind hydraulics shelf 74 and stays in channel 32 to go behind platen 42 to enter cavity 70. The strings 50 and 52 must then be placed on the back side and the bottom side of the compacted cube of trash without removing the cube of trash from the cavity.

Figure 2:
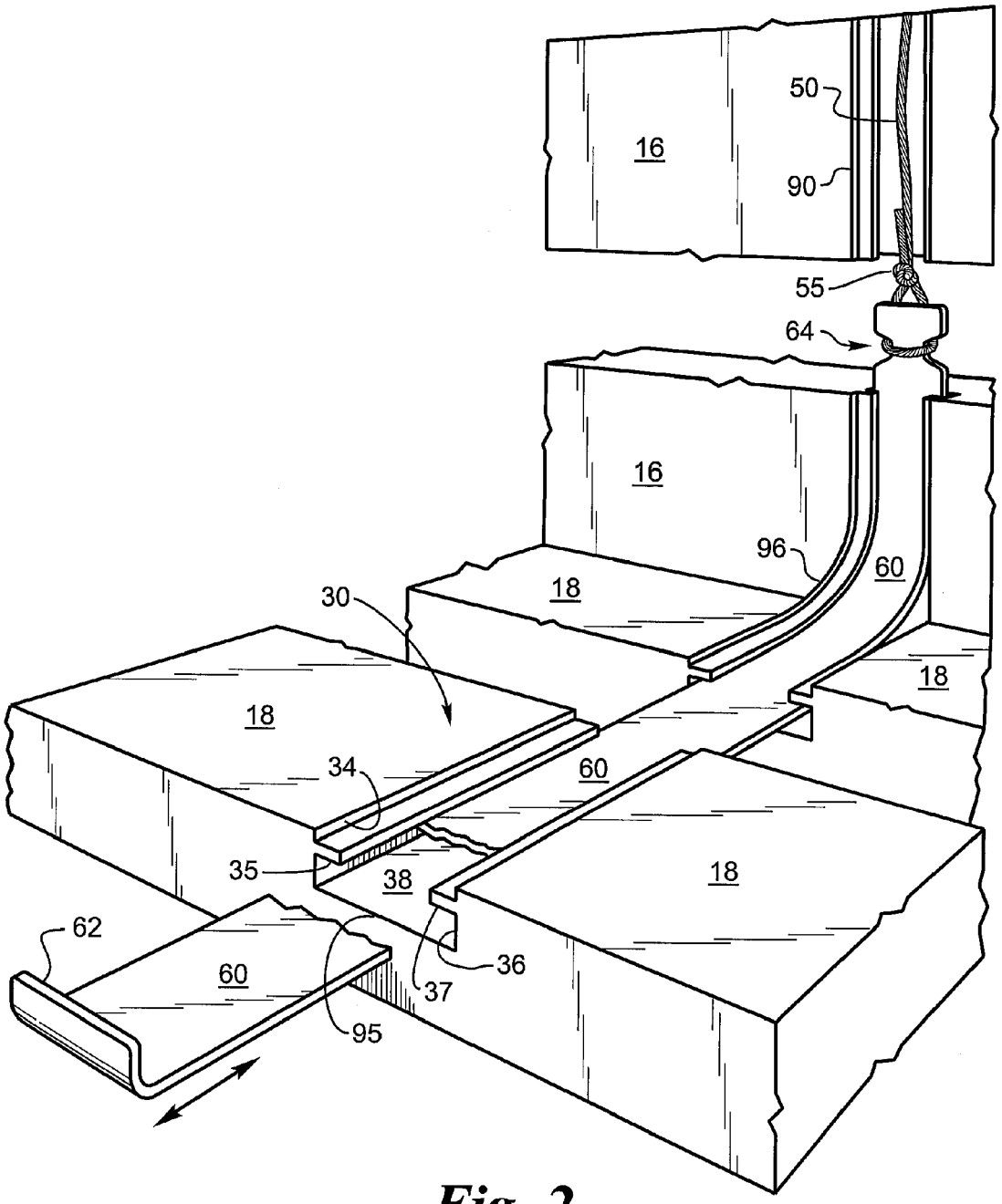
FIG. 2 is a perspective view of the baling strap in a channel in the trash compactor cavity.

In order to surround the cube of compacted trash in the trash compactor cavity 70 with the strings 50 and 52 the trash compactor cavity 70 has a first channel 30 and a second channel 32 in which straps 60 reside. Strap 60 has a front end with a handle portion 62 bent perpendicular to the strap 60 and an indented portion 64 at the back end for engaging the string 50, 52. As FIG. 2 shows a slip knot 55 in the string 50, 52 make a loop around the indented portion 64 of strap 60 and is tightened so that the string 50, 52 tightens around the indented portion 64 and can not be removed from the strap 60. Although a slip knot 55 around an indented portion 64 of the strap 60 is shown for engaging the string 50, 52 to the strap 60 other means such as an aperture in the strap 60 may be used to secure a string 50, 52 and the strap 60.

The channels 30, 32 are U shaped having walls 34, 36 each having overhang portions 35, 37 respectively and a bottom surface 38. The strap 60 is inserted between the base of the overhang portions 35 and 37 and the bottom 38 such that the strap 60 resides in the bottom of the channel 30, 32 where the compacted trash is less likely to exert a force on and impede the sliding of the strap 60 or strings 50, 52 in the channel 30 or 32.

The strap 60 is preferably a long wide strip of material such as steel which can slip inside of the channel 30 between the overhang portion 35 and the base 38 such that the string 50, 52 when attached at the top back wall at position 90 of the channel 30, 32 can be pulled by the strap 60 to the front bottom at position 95 of the channel 30, 32. Although a steel strap is shown herewith any material for the strap 60 may be used so long as it is flexible enough to negotiate the channel 30, 32 and is strong enough to pull the string 50, 52 through the channel.

The strap 60 is designed to be in the bottom of the channel 30 so as to be able to be pulled from the top back position 90 to the bottom front position 95 and to smoothly transition from vertical to horizontal in curved portion 96 such that the strap 60 can move without resistance from the compacted trash residing above the walls 34, 36 of the channels 30, 32. The string 50, 52 is pulled along with the strap 60 in channels 30, 32 without resistance on the compacted trash in the cavity because the string is also in channel 30, 32. With the string 50, 52 exposed at the bottom front position 95 of the compacted trash additional string can be pulled from the spool 46, 48 either at the position 90 at the top of the channels or at the bottom front at position 95 of the channels 30, 32, or both to tie the compressed trash to form a bale. The straps 60 can then be reinserted into the channels at the bottom front position 95 and pushed back to the top rear at position 90. The bail of compacted trash can now be removed from the cavity of the trash compactor.

As an aid to removing the bale of compacted trash from the compactor cavity 70 a strap 100, can be used to help pull the bale from the cavity 70. The applicant's patent U.S. Pat. No. 5,062,358 is attached hereto and incorporated herein by reference to show how the strap 100 can be used to remove the bale from the trash compactor cavity 70.

The trash compactor 10 may be on wheels 20 for ease of transport or reside directly on the floor for stability.

Door 24 on the front of compactor 10 allows access to string 50, 52 on string spools 46, 48 for replacing the string spools and for accessing the hydraulics 44.

Obviously, many modifications and variations of the present invention are possible in light of the above teachings. It is therefore to be understood that, within the scope of the appended claims, the invention may be practiced otherwise than as specifically described.

What is claimed is:

1. A trash compactor comprising:

a cavity having a back wall, and a bottom wall, a flap for access to the cavity to place trash into the cavity for compacting, a platen for compressing the trash in the cavity, a door for access to the cavity to remove compacted trash, at least one continuous channel beginning in an upper portion of the back wall and traversing to a front of the bottom wall, the channel having a curved portion transitioning from the back wall to the bottom wall, a strap for traveling inside of the channel, the strap having an indented portion at a back end thereof, a storage compartment for string used to tie around a bale of trash in the trash compactor cavity, such that string from the storage compartment can be attached to the indented portion of the strap and pulled through the at least one channel to provide string on a bottom and back sides of compacted trash in the cavity, the string then surrounding the compacted trash and tied off to secure the bale of compacted trash prior to removal from the cavity of the trash compactor.

2. A trash compactor as in claim 1 wherein, the channels is U-shaped and having sidewalls, each of the sidewalls having an overhang proximate a bottom of the channel, such that the strap resides between the overhang and the bottom of the channel and between the channel side walls.

3. A trash compactor as in claim 1 wherein, the strap has a handle portion on a front end such that the strap may be pulled out of the channel.

4. A trash compactor as in claim 1 wherein, apertures in the storage compartment allow string to enter the cavity.

* * * * *